US011834909B1

(12) United States Patent
Ruttley et al.

(10) Patent No.: US 11,834,909 B1
(45) Date of Patent: Dec. 5, 2023

(54) CUTTER INSERT FOR A SECTION MILLING TOOL

(71) Applicant: Dynasty Energy Services, LLC, Lafayette, LA (US)

(72) Inventors: David J. Ruttley, Alexandria, LA (US); Darrell Wall, Abbeville, LA (US)

( * ) Notice: Subject to any disclaimer, the term of this patent is extended or adjusted under 35 U.S.C. 154(b) by 0 days.

(21) Appl. No.: 18/174,967

(22) Filed: Feb. 27, 2023

(51) Int. Cl.
*E21B 29/00* (2006.01)
*E21B 10/46* (2006.01)

(52) U.S. Cl.
CPC ..... *E21B 10/46* (2013.01); *E21B 29/002* (2013.01)

(58) Field of Classification Search
CPC ..... E21B 10/46; E21B 10/52; E21B 10/56; E21B 10/5671; E21B 10/5673; E21B 29/002; B23B 27/143; B23B 27/145
See application file for complete search history.

(56) References Cited

U.S. PATENT DOCUMENTS 4,461,602 A 7/1984 Zettl
5,249,894 A * 10/1993 Bernadic ..... B23B 27/143 D15/139
5,383,750 A 1/1995 Satran et al.
6,599,061 B1 * 7/2003 Nelson ..... B23B 27/143 407/115
7,220,083 B2 5/2007 Festeau et al.
7,455,483 B2 11/2008 Koskinen
7,905,689 B2 3/2011 Dufour et al.
8,267,623 B2 9/2012 Park et al.
8,821,080 B2 9/2014 Festeau et al.
8,926,234 B2 1/2015 Engström et al.
9,586,264 B2 3/2017 Jean-Luc et al.
9,597,733 B2 * 3/2017 Fujii ..... B23B 27/143
9,975,188 B2 5/2018 Roman et al.
10,260,302 B2 4/2019 Balasubramanian et al.
10,300,538 B2 5/2019 Oprasic et al.
11,248,430 B2 2/2022 Ruttley et al.
2014/0246242 A1 * 9/2014 Radford ..... E21B 10/54 175/263
2015/0211315 A1 * 7/2015 Ruttley ..... E21B 29/005 166/55.7

* cited by examiner

*Primary Examiner* — Christopher J Sebesta

(57) ABSTRACT

A cutting insert having an insert body with an upper surface. The upper surface of the insert body has an exterior cutting surface having an exterior cutting edge and an interior cutting surface having an interior cutting edge. The exterior cutting surface extends peripherally around and is coplanar with the upper surface of the insert body. The interior cutting surface is also coplanar with the upper surface of the insert body and is positioned within and is concentric with the exterior cutting surface. An exterior chip break separates the exterior cutting surface from the interior cutting surface.

20 Claims, 4 Drawing Sheets

CUTTER INSERT FOR A SECTION MILLING TOOL

FIELD OF THE INVENTION

The present invention relates to the field of sub-surface well bore tools and equipment and, more particularly, relates to an improved cutter insert for use with a section milling tool.

BACKGROUND OF THE INVENTION

During the drilling, production, and remediation of oil and gas wells it is necessary to utilize sub-surface or downhole tools and equipment. Such downhole tools and equipment includes milling tools that are inserted into a wellbore tubular string lining the peripheral surfaces of a wellbore for cutting or milling through the tubular string. Such milling tools often employ rotating cutting blades having cutting inserts with harden cutting surfaces that engage the surfaces of the pipe tubulars lining the wellbore. The hardened cutting surfaces often have cutting edges comprised of a carbide surface, a polycrystalline diamond surface, or the like to facilitate milling and cutting. The cutting surfaces of the cutting inserts are subject to extreme wear during operation of the milling tools.

Section milling tools, used for cutting windows or openings through a section of a tubular string or multiple tubing strings, may utilize a cutting blade positioned parallel to the interior wall of the wellbore tubular. The cutter inserts are mounted to the cutting blades to be the cutting interface face between the cutter blade and wellbore tubular. A plurality of individual cutter inserts are often utilized and each of the inserts will have a cutting section and an adjacent grooved or notched portion called a chip break. The chip break portion of the cutter insert is provided to break the stringy metal cuttings produced during milling into small more manageable chips or swarf that can be readily removed by fluids circulating in the wellbore.

Because of the extreme wear and tear on the cutter inserts during milling operations, frequent replacement of the cutter inserts and their associated cutter blades is often necessary in order to facilitate the section milling operations. The wear and tear on the cutter inserts reduces cutter efficiency and replacement of the cutter inserts or cutter blades increases time as the milling tools must be pulled from the wellbore tubular string in order for the cutter inserts and cutter blades to be replaced.

Consequently, there is a need for a cutter insert for a section milling tool that will extend the cutting life of the insert and reduce the need for frequent replacement of the cutter inserts or the associated cutter blades.

There is also a need for a cutter insert having multiple cutting sections in order to reduce wear on the cutter insert.

There is also a need for a cutter insert having cutter sections arranged to sequentially engage a the tubular to be milled.

Such a cutter insert will expedite section mill operations by decreasing the time associated with cutting sections through wellbore tubulars and reducing the frequency of cutter insert replacement which will result in reduced rig time and the overall cost of milling operations.

SUMMARY OF THE INVENTION

The present invention provides a cutter insert designed to satisfy the aforementioned needs. The cutter insert of the present invention provides a cutter insert with a hexahedron-shaped body, the upper surface of which has a plurality of concentric cutting surfaces with associated concentric chip breaks. The concentric cutting surfaces on the upper surface of the cutter insert are configured to sequentially engage the surface of a wellbore tubular during milling operations. The sequential engagement of the cutting surfaces of the cutter insert with the tubular surface will serve to prolong the life of the cutter insert during milling.

The concentric cutting surfaces on the upper surface of the cutter insert are preferably configured as an exterior quadrilateral-shaped cutting surface that extends around the periphery of the upper surface of the cutter insert and a concentric interior quadrilateral-shaped cutting surface positioned with the exterior cutting surface. The exterior cutting surface and the concentric interior cutting surface are preferably shaped as squares or rectangles. A first exterior chip break, configured as a triangular notch or a trapezoidal-shaped channel in the top surface of the cutter insert, separates the exterior cutting surface and the interior cutting surface. A recessed area within the top surface inside the interior cutting surface creates a second interior chip break. The flat coplanar top surfaces and cutting edges of the exterior cutting surface and the interior cutting surface have hardened surfaces such as surfaces comprised of carbide, polycrystalline diamond surfaces, or similar hardened surfaces to facilitate milling.

For use, a plurality of cutter inserts is arrayed upon and attached to the surface of a cutter blade or upon a cutter carrier attached to a cutter blade of a milling tool. Preferably, the plurality of cutter inserts will be staggered along the cutter blade to maximize engagement of the cutting surfaces of the cutter inserts with the tubular to be milled. The cutter inserts are attached to the surface of the cutting blade or cutter carrier by a matrix of welding, brazing, or cementing material such as one comprising tungsten carbide powder or similar hardened metal.

DETAILED DESCRIPTION OF THE INVENTION

Figure 1:
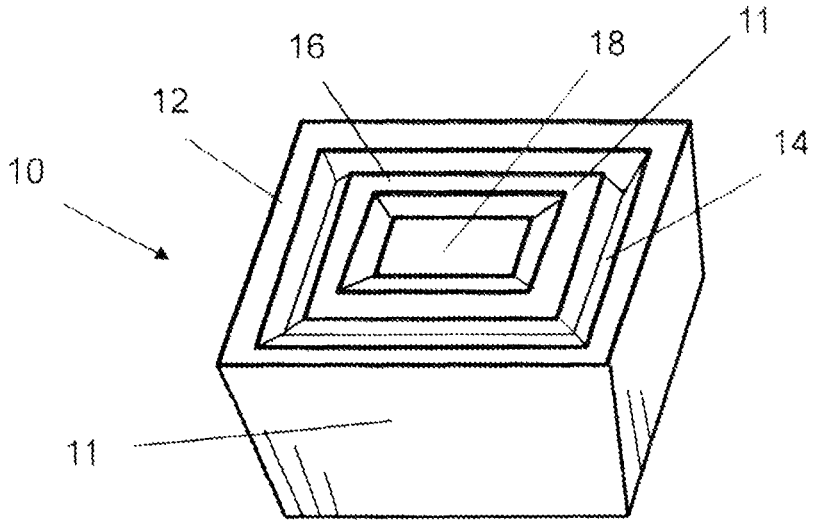
FIG. 1 is a schematic perspective view of the cutting insert of Applicant's invention.
Figure 2:
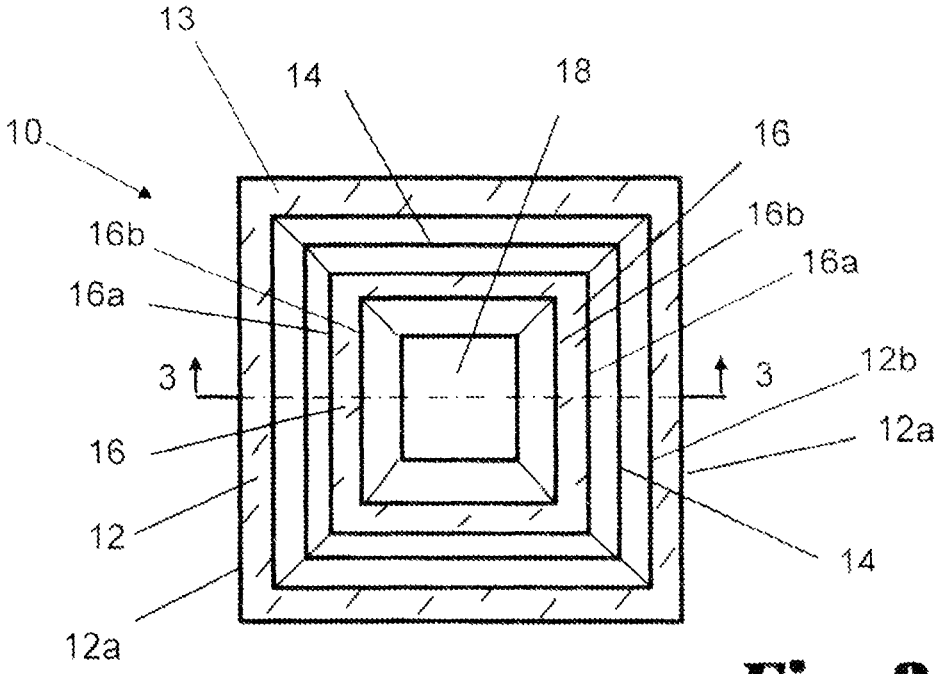
FIG. 2 is a schematic top view of cutting insert shown in FIG. 1.
Figure 3:
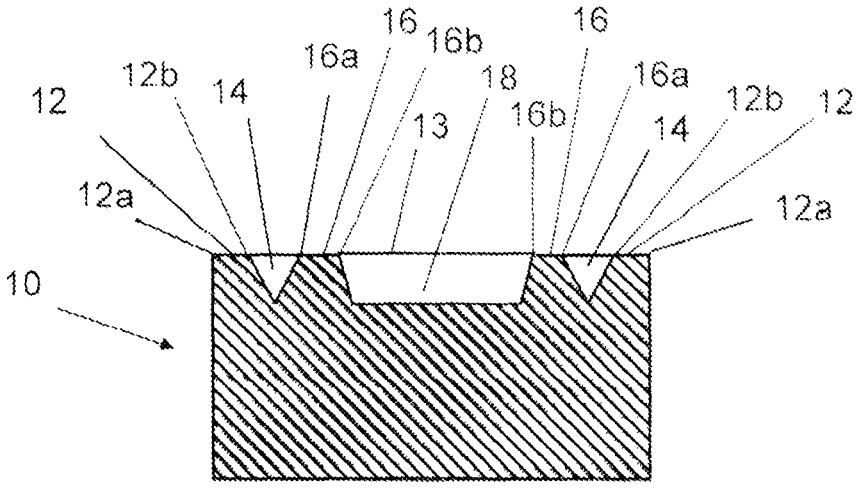
FIG. 3 is a cross-section view of the cutting insert cut along section 3-3 shown in FIG. 2.

The cutter insert (10) of the present invention is shown in FIGS. 1-3. The cutter insert (10) shown preferably has a body (11) configured as a cube having an upper surface (13). The upper surface (13) of the cutter insert (10) has an exterior square-shaped cutting surface (12) having a cutting edge (12*a*) and a cutting edge (12*b*) and a coplanar concentric interior square-shaped cutting surface (16) having a cutting edge (16*a*) and a cutting edge (16*b*). The exterior cutting surface (12) extends around the periphery of the upper surface (13) of the cutter insert (10) and the coplanar concentric interior cutting surface (16) is positioned with the exterior cutting surface (12).

The exterior cutting surface (12) and the interior cutting surface (16) are preferably square-shaped and are separated by a first recessed exterior chip break (14), configured as a triangular notch or a trapezoidal-shaped channel. A second interior chip break (18) is created by a recess, such as a trapezoidal shaped indentation, positioned within the surrounding interior cutting surface (16). The cutting insert (10), the exterior cutting surface (12), and the interior cutting surface (16) are hardened surfaces comprised of carbide surfaces, polycrystalline diamond surfaces, or similarly hard surfaces to facilitate milling. The body (11) of the cutter insert (10) may also be configured in other hexahedron shapes, such as a rhombohedron or rhomboid shaped body, a three-dimension rectangle or cuboid shaped body, or a three dimension trapezium or trapezoid shape, and with more than two concentric cutting surfaces and chip breaks.

The coplanar exterior cutting surface (12) and interior cutting surface (16) are coplanar with the upper surface (13) of the cutter insert (10) and are configured to sequentially engage the interior peripheral surface of a wellbore tubular during milling operations. The sequential engagement of the exterior cutting surface (12) and the interior cutting surface (16) with the interior peripheral surface of the wellbore tubular will serve to prolong the life of the cutter insert (10) during milling and decrease the time associated with such milling.

Figure 4:
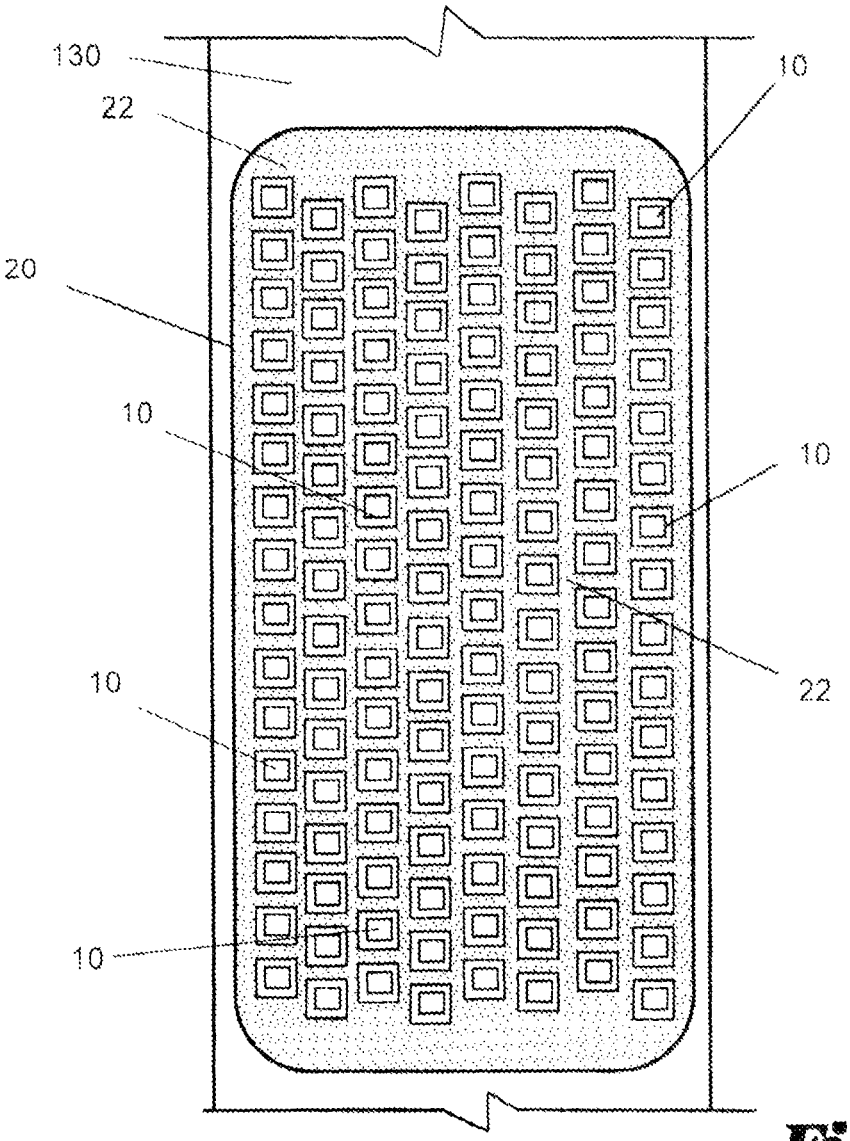
FIG. 4 is a schematic front view of a cutter blade and cutter carrier of a milling tool arrayed with a plurality of cutter inserts such as that shown in FIG. 1.

For use in a section mill, a plurality of cutter inserts (10) is arrayed upon and attached to the surface of a cutter carrier (20) by a matrix (22) of welding, brazing, or cementing material such as one comprising tungsten carbide powder or similar hardened metal material as shown in FIG. 4. Preferably, the plurality of cutter inserts (10) will be staggered in the array along the cutter carrier (20) as shown to maximize engagement of the cutting surfaces (12) and (16) of the cutter inserts (10) with the wellbore tubular to be milled. The cutter carrier (20) with the plurality of cutter inserts (10) may be attached to a cutter blade (130) of a milling tool as shown, or the plurality of cutter inserts (10) may also be attached directly to the cutter blade.

Figure 5:
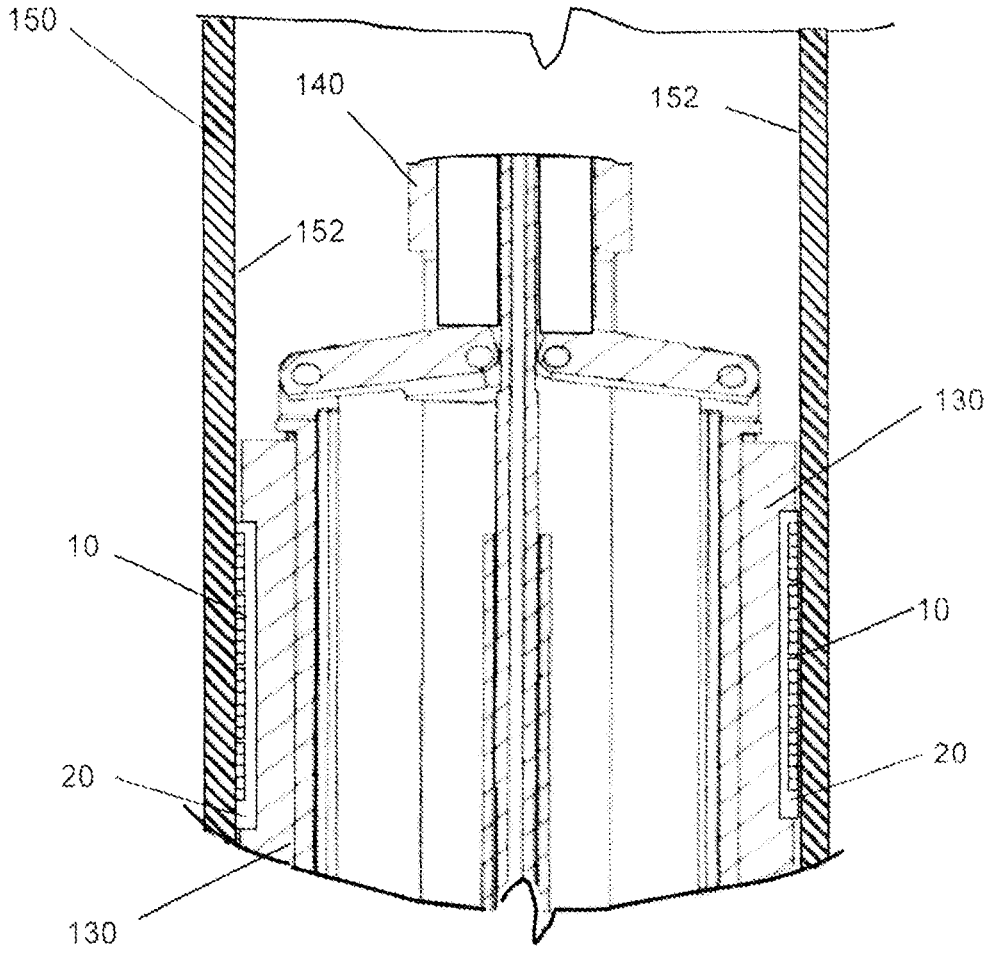
FIG. 5 is a schematic side view of a portion of a milling tool having a cutter carrier arrayed with a plurality of cutter inserts such as that shown in FIG. 1.

FIG. 5 shows a cutter carrier (20) with a plurality of cutter inserts (10) mounted to a radially extendable cutter blade (130) of a milling tool (140) positioned in a wellbore tubular (150) for milling through its interior wall (152). U.S. Pat. No. 11,248,430 B2 entitled "Multi-string Section Mill, describes such a milling tool. The milling tool (140) will rotate the cutter blade (130) within the wellbore tubular (150) around its interior wall (152) to engage the associated cutter inserts (10) with the interior wall (152) in order mill an opening through the wellbore tubular (150). Because the exterior cutting surface (12) and the interior cutting surface (16) of the cutter insert (10) are concentrically and sequentially arranged, when the cutting blade (130) rotates during the milling process, the cutting edge (12*a*) of the exterior cutting surface (12) of each cutter insert (10) will be engaged with and rotated against the interior wall (152) of the wellbore tubular (150) before the cutting edge (16*b*) of the interior cutting surface (16) is engaged with the interior wall (152). As milling occurs, stringy metal cuttings are produced and are broken into manageable chips or swarf by the chip breaks (14) and (18).

Figure 6:
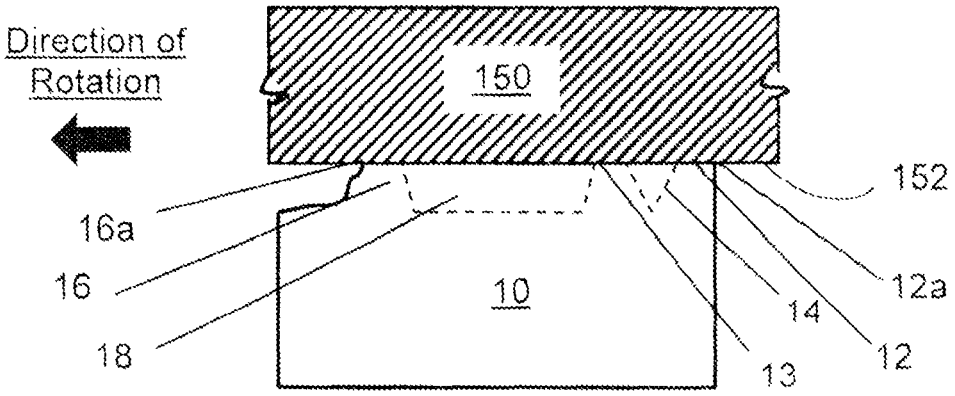
FIG. 6 is a schematic side view of the cutting insert of FIG. 1 illustrating the wearing away of the first cutting surface during engagement of the cutter insert shown in FIG. 1 with the interior of a wellbore tubular.

During milling, as shown in FIG. 6, the cutting edge (12*a*) of the exterior cutting surface (12) of each cutter insert (10) is engaged with and rotated against the interior wall (152) of the wellbore tubular (150) before the cutting edge (16*a*) of the interior cutting surface (16). Consequently, the cutting edge (12*a*) of the exterior cutting surface (12) will be subject to less wear tear than the cutting edge (16*a*) of the interior cutting surface (16).

If the cutting edge (12*a*) of the exterior cutting surface (12) of the cutter insert (10) wears or erodes away during milling, the cutting edge (16*a*) of the coplanar interior cutting surface (16) will continue to be engaged with and rotated against the interior wall (152) surface of the wellbore tubular (150) for milling. This sequential engagement of the cutting surfaces (12) and (16) reduces the frequency replacing cutter carriers (20) and associated cutter inserts (10) as milling progresses, increases milling efficiency, and thus reduces the rig time and the associated cost of milling of milling operations.

The invention claimed is:

1. A cutting insert comprising:

a. an insert body having an upper surface;

b. an exterior cutting surface having an exterior cutting edge, said exterior cutting surface extending peripherally around and coplanar with said upper surface of said insert body;

c. an interior cutting surface having an interior cutting edge; said interior cutting surface positioned within and concentric with said exterior cutting surface, said concentric interior cutting surface coplanar with said exterior cutting surface; and d. an exterior chip break separating said exterior cutting surface from said concentric interior cutting surface.

2. The cutting insert recited in claim 1 further comprising an interior chip break comprising an indentation in said upper surface of said insert body within said interior cutting surface.

3. The cutting insert recited in claim 2, wherein said exterior cutting surface and said interior cutting surface are hardened cutting surfaces.

4. The cutting insert recited in claim 3, wherein said exterior cutting surface is comprised of a recess in said upper surface of said insert body.

5. The cutting insert recited in claim 4, wherein said insert body is configured as a cube.

6. The cutting insert recited in claim 5, wherein said exterior cutting surface and said concentric interior cutting surface are square-shaped cutting surfaces.

7. The cutting insert recited in claim 4, wherein said insert body is configured as a cuboid.

8. The cutting insert recited in claim 7, wherein said exterior cutting surface and said concentric interior cutting surface are rectangle-shaped cutting surfaces.

9. A cutting insert comprising:

a. A cube-shaped insert body having an upper surface;

b. a square-shaped exterior cutting surface having exterior cutting edges, said exterior cutting surface and said exterior cutting edges extending peripherally around and entirely coplanar with said upper surface of said insert body;

c. a square-shaped interior cutting surface having interior cutting edges; said interior cutting surface and said interior cutting edges positioned within and concentric with said exterior cutting surface; and wherein said interior cutting surface and said interior cutting edges are entirely coplanar with said exterior cutting surface;

d. an exterior chip break separating said exterior cutting surface from said concentric interior cutting surface; and e. a recessed interior chip break positioned within said interior cutting surface.

10. The cutting insert recited in claim 9, wherein said cutting edges of said exterior cutting surface and said cutting edges of said interior cutting surface have hardened cutting surfaces.

11. In a section milling tool having extendable and rotatable cutting blades having cutter inserts for milling through the interior surface of a wellbore tubular, said cutter insert comprising:

a. an insert body having a flat upper surface;

b. said flat upper surface of said insert body having an exterior cutting surface having an exterior cutting edge extending around the periphery of said exterior cutting surface, wherein the entirety of said exterior cutting surface and the entirety of said exterior cutting edge are coplanar with said flat upper surface of said insert body;

c. said flat upper surface of said insert body having a flat interior cutting surface positioned concentrically within said exterior cutting surface, said interior cutting surface having an interior cutting edge extending around the periphery of said interior cutting surface, wherein the entirety of said interior cutting surface and the entirety of said interior cutting edge are coplanar with said flat upper surface of said insert body;

d. an exterior chip break separating said exterior cutting surface from said interior cutting surface; and e. a recessed interior chip break positioned within said interior cutting surface.

12. In the section milling tool recited in claim 11, wherein said exterior cutting surface and said interior cutting surface are hardened cutting surfaces.

13. In the section milling tool recited in claim 12, wherein said hardened cutting surfaces include surfaces comprising carbide.

14. In the section milling tool recited in claim 13, wherein said insert body of said cutter insert has a shape selected from the group comprised of a cube shaped body, a cuboid shaped body, a rhomboid shaped body, or a trapezoid prism shaped body.

15. In the section milling tool recited in claim 14, wherein said exterior cutting surface and said interior cutting surface of said cutter insert are concentrically aligned.

16. In the section milling tool recited in claim 14, wherein said exterior cutting surface and said interior cutting surface of said cutter insert are configured to sequentially engage the interior surface of said wellbore tubular.

17. A cutting insert comprising:

a. an insert body having a flat planar top surface, said flat planar top surface of said insert body comprised of a polygon-shaped exterior cutting surface having interior and exterior cutting edges and a polygon-shaped coplanar interior cutting surface having exterior and interior cutting edges, said polygon-shaped interior cutting surface being concentrically aligned with said polygon-shaped exterior cutting surface;

b. a first chip break comprised of a channel extending peripherally around said polygon-shaped interior cutting surface thereby separating said polygon-shaped exterior cutting surface from said polygon-shaped interior cutting surface;

c. a second chip break comprised of a recess surrounded by said interior cutting surface; and d. wherein said interior and exterior cutting edges of said exterior cutting surface and said interior and exterior cutting edges of said interior cutting surface are coplanar with said flat planar top surface of said insert body.

18. The cutting insert recited in claim 17, wherein said cutting edges of said exterior cutting surface and said concentric interior cutting surface are hardened cutting surfaces.

19. The cutting insert recited in claim 18 wherein said exterior cutting surface and said concentric interior cutting surface are rectangular cutting surfaces.

20. The cutting insert recited in claim 19 wherein said first chip break is a trapezoidal channel.

* * * * *